US005167600A

United States Patent [19]

Baird

[11] Patent Number: 5,167,600

[45] Date of Patent: Dec. 1, 1992

[54] ADJUSTABLE WEIGHT POSITIONING HARNESS SYSTEM

[76] Inventor: Richard T. Baird, 185 Spring St., Gloversville, N.Y. 12078

[21] Appl. No.: 559,207

[22] Filed: Jul. 30, 1990

[51] Int. Cl.[5] ..... A63B 21/065

[52] U.S. Cl. ..... 482/105; 482/93; 482/100

[58] Field of Search ..... 272/93, 94, 116, 117, 272/119, 122, 123, 143; 482/10, 92, 93, 94, 105, 106, 108, 139, 104

[56] References Cited

U.S. PATENT DOCUMENTS

| | | | |
|---|---|---|---|
| 1,047,212 | 12/1912 | Hamilton . | |
| 2,617,650 | 11/1952 | Landis | 272/122 |
| 3,679,107 | 7/1972 | Perrine . | |
| 3,759,510 | 9/1973 | Jackson, Jr. | 272/119 |
| 4,339,124 | 7/1982 | Vogler . | |
| 4,676,502 | 6/1987 | Mahr . | |
| 4,714,247 | 12/1987 | Gerstong | 272/119 X |
| 4,944,509 | 7/1990 | Snider | 272/119 |
| 4,948,122 | 8/1990 | Addrew, Sr. | 272/119 |

FOREIGN PATENT DOCUMENTS

| | | | |
|---|---|---|---|
| 1489787 | 6/1989 | U.S.S.R. | 272/119 |

*Primary Examiner*—Robert Bahr

*Attorney, Agent, or Firm*—Schmeiser, Morelle & Watts

[57] ABSTRACT

An adjustable weight position harness system having a backpack like harness and a rigid frame with a slidable weight support which is movable up and down the frame a distance of at least 8 inches and may be secured at any point between its upper and lower positions without removing the harness. A freestanding harness rack having adjustable support rods which extend outwardly and slightly upwardly and correspond to eyelets in the harness so that the user may walk the harness onto the support rack for easy and safe engagement or disengagement of the harness and alteration of the weights and weight positoning.

6 Claims, 2 Drawing Sheets

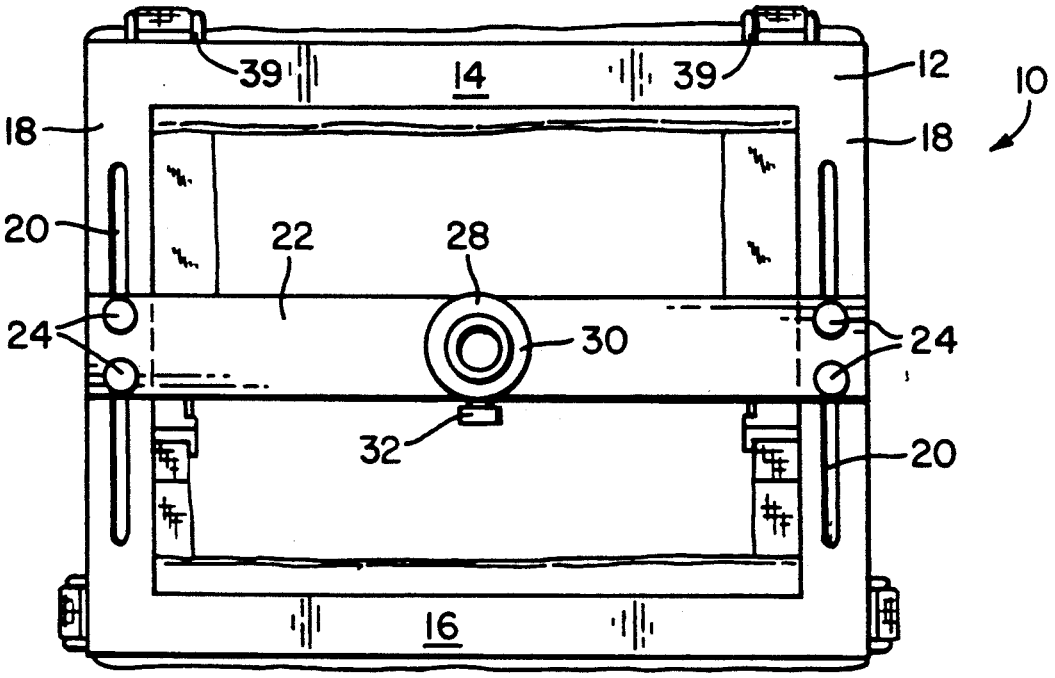
FIG. 1
FIG. 2
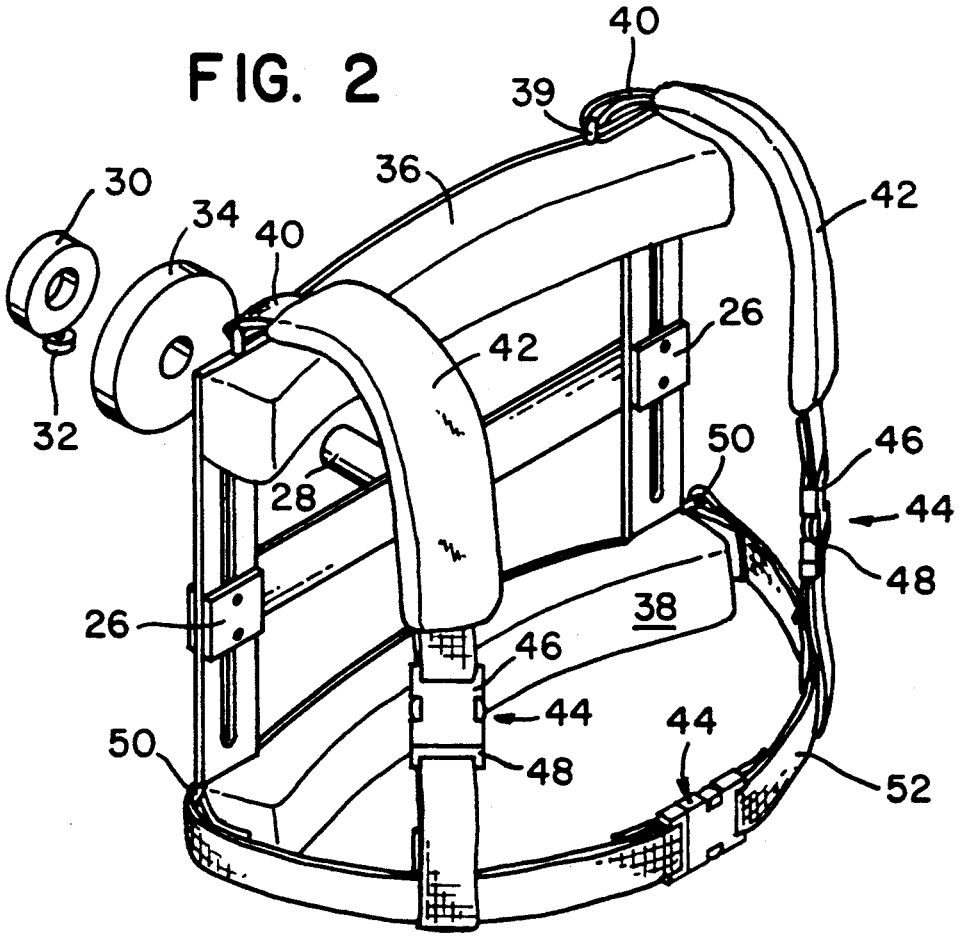

ADJUSTABLE WEIGHT POSITIONING HARNESS SYSTEM

FIELD OF THE INVENTION

Generally, this invention relates to exercise equipment and weight supports. More specifically, the invention is a weight harness and support rack wherein the harness has a weight receiver which is movable to a plurality of positions on the harness, and an adjustable harness rack for supporting the harness when changing and positioning the weights.

BACKGROUND OF THE INVENTION

The need to exercise particular muscles and muscle groups during weight training has resulted in the development of numerous weight training devices. A large number of these devices are exercise specific meaning that they are designed to exercise a particular muscle or muscle group but are not sufficiently versatile to be used for other areas. For example, lifting yokes are common and provide a holder for a barbell when placed across the back of a weight lifter's shoulders. Other devices allow for weights to be attached to a particular carrier which is in turn secured to a particular part of the body. Devices of the latter type include helmets with weight holders, ankle weights, wrist weights and the like. These devices seek only to secure a particular weight or set of weights in a single position so that the user may go through a typical exercise routine including running and jogging with the added weight securely attached to his or her body.

Numerous other exercises are simply done through the positioning of a barbell or other weight holder.

These approaches are suitable in the early stages of training where the weight used is relatively minimal. However, as the serious weight lifter begins to increase his weight limit in order to push the muscles to their maximum potential it is almost always necessary to use a spotter who helps the weight lifter get the weights into position and then monitors the exercise to assure that the weights do not fall. At the end of an exercise routine, the spotter is available to guide the weights either to the floor or some holder mechanism.

Numerous injuries occur as the amount of weights increase and mistakes become more dangerous. These injuries can occur for a number of reasons such as a misunderstanding between the spotter and the weight lifter, the inability of the spotter to sufficiently support the weight load, and the slipping of the weights from the weight lifters grasp. Generally, overconfidence of the weight lifter and the desire to continue from one exercise to the next in relatively rapid succession will also often lead the weight lifter to proceed without a spotter. Other injuries also occur as weights are not properly secured to the weight lifter during exercise and either impact upon him or else disengege. Less apparent dangers exist for the weight lifter utilizing a weight/body attachment system where the weights are not positioned in the proper area and proceeding through an exercise routine will strain certain muscles which are bearing an excess amount of the weight load.

In an attempt to overcome many of these difficulties, a wide variety of complex exercise machinery has been developed. While all of these machines have certain advantages and disadvantages, they all have several common drawbacks, the first and perhaps the most prohibitive is that of cost. Secondly, the action of the weights is often dissimilar to free weights which many weight lifters prefer. Third, as the complexity of the machine increases the versatility generally decreases so that a particular machine can only be used for a specific muscle group.

More common difficulties relate to the actual gym environment. During weight training, it is desirable to move with a certain degree of speed from one exercise to the next in order to assure that the proper workout is being obtained. In addition, it is also advantageous to complete a workout in a specific sequence so that particular group of muscles are not being over stressed during part of the workout and ignored during other parts. While this is not difficult to achieve when one is working out individually, most gyms experience a large influx of weight lifters in the prework hours, during lunchtime and after work. This often results in an undesirable delay as you wait for a slower weight lifter to move onto the next machine so that you can take over his position. Also causing a problem is the fact that many of these machines must be adjusted for particular weights and for particular body sizes which often requires adjustment of each machine prior to the workout.

Another safety concern is the fact that with free weights one generally uses a standard weight bar which is approximately seven feet long. Thus, as a number of individuals work out with these free weights, if someone should lose their balance or fall, nearby weight lifters can be put at risk.

One other important aspect to weight lifting is the need to maintain a consistent program at least three or four days a week. In fact, in some cases it is desirable to exercise daily but simply alter the exercise routines so that different muscle groups are being utilized on adjacent days. Maintaining this consistency can be difficult as ones schedule may not always coincide with the schedule at the gym or where traveling to a gym becomes inconvenient or impossible due to travel distances, weather conditions or the like. Should the weight lifter travel, the need for different exercise equipment or access to a gym will often prevent weight lifters from maintaining their exercise program.

Recently, body building shows and competitions have become quite popular. Traditionally, these shows provide a small supply of weights backstage so that participants can do their final preparations prior to the show. However, as anyone who has ever been involved in these shows realizes, the number and type of weights available are generally insufficient to allow one to satisfactorily pump up prior to going on stage.

Accordingly, it was with these ideas in mind that I began developing a more versatile weight device which could be used to secure weights to an individual in a variety of positions. However, the device needed to allow for these positioning variations in a safe and convenient way so as to avoid injury. I accordingly developed the subject invention which allows the user more versatility than has been heretofore available with a simpler and safer device which is not only easy to use but also relatively inexpensive.

SUMMARY OF THE INVENTION

The subject invention provides a safer and more versatile weight harness than heretofore available. This is accomplished by providing a backpack like device having shoulder straps and a waist belt for securing the harness to the user. The metal frame portion of the harness is secured by the shoulder straps and waist belt to the user and is positioned either on the user's back or chest depending on the exercises to be performed.

A weight receiving support is slideably mounted to the frame providing at least an 8 inch distance for altering the position of the weights. When worn on the back, this allows the weights to be moved generally from the shoulder blades down to the small of the back and if worn on the front, the weights may be moved from the sternum down toward the midsection about at the point of the last or floating rib.

While those who weight lift will appreciate the importance of this versatility, the following examples will demonstrate the value of this advantage. Thus, when positioned on the top of the slide, the weight is positioned properly for back squats. When placed in the middle of the slide the weights are in the preferred position for performing lunges. When placed at the bottom of the slide the weights are in the proper position for donkey calf raises. In addition, the weights can be worn on the front of the user for doing sit-ups and the like. Virtually all other exercises may be enhanced by the proper application of weights and positioning with the subject invention.

With some exercises, movement of the weights will alter the muscle group being most actively exercised. For example, if the weights are put to the top of the slide while doing dips, the user will obtain the best workout for his or her chest muscles. However, if the slide is moved down toward the middle while doing the same dips more work is performed by the triceps and less by the chest.

By locating the weights on a slide, the weight lifter or fellow weight lifter can easily adjust the position of the weights without removing the weights or having the user remove the harness. This is especially helpful as one seeks to move quickly through a,set of exercises in order to maintain a preferred exercise rhythm.

The system also includes a free standing harness rack which is between 5½ and 7 feet high. Extending downwardly from the top cross bar of the rack are extension posts, the length of which may be varied to accommodate the height of the particular user. The extension posts have harness support rods which allow the user to secure the harness to the rack.

Through this system, the user can work alone by adjusting the weight support to the appropriate position for the intended exercise, loading the weights onto the support and locking them in place, and then donning the harness after which the user can raise the harness slightly and virtually walk it off its support position on the rack.

When returning to the rack the user can hold the legs of the rack for support and simply slide the eyelets on the harness back over the rack support rods. The harness is then removed and whatever adjustments necessary can be made and the process repeated for the various exercises.

It will be appreciated that loading and unloading the harness from the rack is even easier when the harness is mounted on a person's chest.

While the above describes some of the advantages of the subject invention, a true appreciation for the versatility, safety and effectiveness of this invention will be more fully appreciated through its use by weight lifters.

BRIEF DESCRIPTION OF THE DRAWINGS

FIG. 1 is a rear elevational view of the harness;

FIG. 2 is a front perspective view of the harness with weights and attachment;

DETAILED DESCRIPTION OF THE PREFERRED EMBODIMENT

Figure 3:
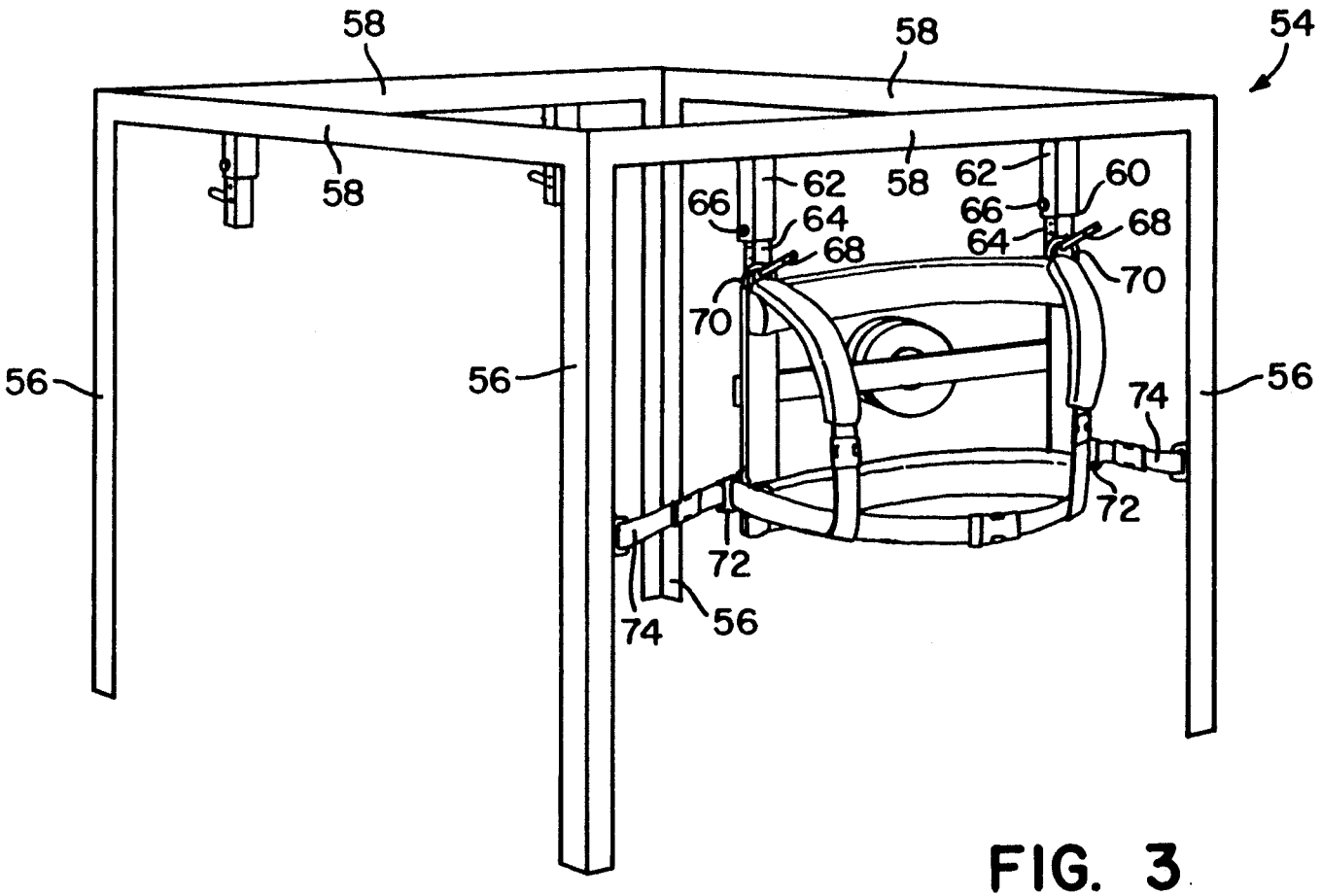
FIG. 3 is a prospective view of the harness and harness rack.

FIG. 1 discloses the harness generally designated as 10. The harness consists of a rectangular frame 12 having a top support 14, bottom support 16 and parallel side supports 18 which connect the top and bottom supports.

The side supports 18 each contain channels 20 substantially along their length. While the length of the channels may be varied, the preferred length is fourteen inches and they each need to be at least 8 inches long.

Riding within the channels 20 is a weight support 22 which is slidably secured to each of the side supports and spans the distance therebetween. The weight support is slidably secured to move between a raised position toward top support 14 and a lowered position toward bottom support 16. The weight support is secured against movement by knobs 24 which have threaded portions (not shown) which extend through the channel and are secured within pressure plates 26 as shown in FIG. 2. Tightening the knobs 24 fastens the side supports between the weight supports and the pressure plates 26.

Centrally located on the weight support 22 is a weight receiving post 28 which is sized to receive either regular or Olympic weights depending on the usage. A removable collar 30 having a set screw 32 may be slipped over the weight receiving post after the weights 34 are slid on to the weight receiving post. Tightening set screw 32 secures the collar 30 onto the post 28 to prevent the weights from disengaging.

As shown in FIG. 2, across the top support 14 is an upper protection pad 36 and across the bottom support 16 is a lower protection pad 38. Both pads are on the inner surface of the frame which faces the straps 40. The protection pads are of a high density foam so as to protect the user without allowing a significant amount of pad compression. The pads, as well as the top and bottom supports, are curved to better conform either across the individuals back or chest depending on how the harness is worn.

Secured to the top support through top retaining rings 39 are shoulder straps 40, which are padded at 42 for greater comfort during exercising. The shoulder straps are adjustable in length through their attachment to interlocking clasps 44 which are made of a receiver portion 46 and an insertable portion 48. The lower portion of the shoulder strap 40 is secured to the insertable portion 48 at one end and at the other end it wraps around the belt 52.

The belt 52 is attached at its ends to side retaining rings 50 which are located on opposite sides of the frame 12. The belt 52 disengages in the middle at another clasp 44.

It should be appreciated that the protection pads 46 and 48 keep the frame 12 offset from the user's body. Therefore, the weight support 42 can easily be slid along channels 20 while the harness is being worn. If the harness is being worn on the user's chest, the user himself will find it simple to loosen the knobs 24 and the related pressure plates 26 so as to relocate the weight support 22 in the desired position after which the knobs 24 are simply tightened down to fasten the weight support to the frame.

In my preferred embodiment the harness 10 is used in conjunction with a free standing harness rack 54 which stands between 5½ and 7 feet high. The harness rack is square and is supported by four legs 56 which are attached by top cross bars 58. Extending downwardly from one or more cross bars 58 are extension posts 60 which include an outer sleeve 62 and an inner sleeve 64 which slides within the outer sleeve. The inner sleeve 64 has a plurality of holes therethrough so that a pin 66 may be slid through the openings in the outer sleeve and secure the inner sleeve 64 at the desired height.

Extending outwardly and slightly upwardly from the inner sleeve 64 are harness support rods 68. In this embodiment, an alteration is made on the harness such that additional eyelets 70 are secured to the top support 14.

In addition, the retaining rings 50 also have extension eyelets 72 to which a tether 74 may be used to secure the harness to adjacent legs 56.

It should be appreciated that in this configuration the user can simply secure the harness about himself, raise the harness slightly and virtually walk the harness off of the support rod 68. In addition, since the eyelets are rigidly secured so that they always extend upwardly, replacement of the harness is relatively simple. This is especially true when the harness is being worn on the chest and the user can easily align the eyelets and the support rods and simply walks the eyelet 70 over the harness support rods.

While the above describes the preferred embodiment of the invention, it should be appreciated that variations may be made without departing from the scope of the invention which is defined by the appended claims.

I claim:

1. An adjustable weight positioning harness system comprising:

a frame having top and bottom supports;

strap means secured toward both the top support and the bottom support, said strap means adapted to be worn by a weight lifter, securing said frame to the back or chest of the weight lifter;

a weight support movably secured to said frame member for movement between a raised position toward the top support and a lowered position toward the bottom support such that a weight lifter wearing the frame on his back may move the weights between his shoulder blades and the small of the back, and similarly when the frame is positioned on the weight lifters chest the weights may be moved between the user's sternum and the lowest rib while said frame means is being worn by the weight lifter;

an upper protection pad secured to the harness toward the top support and a lower protection pad secured to the harness toward the bottom support, the frame having an inner surface facing toward the harness means, and an outer surface facing away from said harness means, said support pads being secured on the inner surface; and parallel side supports secured between the top and bottom supports, wherein said weight support is movably secured to said side supports and spans the space therebetween, said weight support having a weight receiving post located substantially equi-distance between the side supports and, a removable collar for locking the weights on said post.

2. The invention of claim 1 wherein the distance between the raised position and the lowered position is at least 8 inches.

3. The invention of claim 1 wherein said harness further comprises a belt secured at its ends to opposite sides of the frame and a pair of shoulder straps secured at one end to the frame toward the top supports, the other end of the shoulder straps being secured to the belt; and means for locking the weight support at any point along the range of travel of said weight support as it is moved along the side supports.

4. The invention of claim 1 further comprising eyelets rigidly secured to the frame toward the top support and extending upwardly therefrom.

5. The invention of claim 4 wherein said system further comprises:

a free standing harness rack having harness support rods spaced a distance from each other equal to the distance between the eyelets, said support rods extending outwardly from the rack so that a weight lifter can hook the eyelets onto said support rods for holding the harness and frame.

6. The invention of claim 5 wherein said rack has a plurality of lets, and at least one crossbar secured between the top of said legs; and variable length extension posts extending downwardly from said cross bar, said support rods extending outwardly from said extension posts.

* * * * *